US008991365B2

(12) United States Patent
Konohara

(10) Patent No.: US 8,991,365 B2
(45) Date of Patent: Mar. 31, 2015

(54) BLOWBY GAS RETURNING APPARATUS FOR ENGINE WITH SUPERCHARGER

(75) Inventor: Hirokazu Konohara, Inazawa (JP)

(73) Assignee: Aisan Kogyo Kabushiki Kaisha, Obu, Aichi (JP)

( * ) Notice: Subject to any disclaimer, the term of this patent is extended or adjusted under 35 U.S.C. 154(b) by 9 days.

(21) Appl. No.: 13/434,056

(22) Filed: Mar. 29, 2012

(65) Prior Publication Data

US 2012/0247438 A1 Oct. 4, 2012

(30) Foreign Application Priority Data

Apr. 1, 2011 (JP) ..... 2011-082051

(51) Int. Cl.
*F02B 33/00* (2006.01)
*F01M 13/02* (2006.01)

(52) U.S. Cl.
CPC ..... *F01M 13/022* (2013.01); *F01M 2013/027* (2013.01)
USPC ..... 123/559.1

(58) Field of Classification Search
USPC ..... 123/559.1
See application file for complete search history.

(56) References Cited

U.S. PATENT DOCUMENTS 5,850,823 A * 12/1998 Kasahara ..... 123/572
2005/0090371 A1* 4/2005 Nakajima et al. ..... 477/181
2008/0083399 A1 4/2008 Hirano et al.
2008/0092864 A1* 4/2008 Suzuki et al. ..... 123/574
2008/0257320 A1* 10/2008 Asanuma et al. ..... 123/573
2009/0090337 A1* 4/2009 Asanuma et al. ..... 123/574
2009/0301446 A1 12/2009 Asanuma et al.
2009/0308364 A1* 12/2009 Konohara ..... 123/572
2009/0320809 A1 12/2009 Ruppel et al.
2012/0247438 A1* 10/2012 Konohara ..... 123/559.1

FOREIGN PATENT DOCUMENTS

DE 10 2006 019 634 A1 10/2007
DE 10 2008 029 904 A1 12/2009
GB 2459962 A 11/2009
JP H04-292516 10/1992
JP A-2004-60475 2/2004
JP A-2008-95528 4/2008

(Continued)

OTHER PUBLICATIONS

Jul. 6, 2012 Extended European Search Report issued in European Patent Application No. 12162101.5.

(Continued)

*Primary Examiner* — Lindsay Low
*Assistant Examiner* — Charles Brauch
(74) *Attorney, Agent, or Firm* — Oliff PLC

(57) ABSTRACT

An upstream side and a downstream side of a supercharger in the intake passage are connected through a bypass passage in which an ejector is provided. An outlet of a first blowby gas returning passage is connected to the bypass passage through the ejector. An outlet of a second blowby gas bypass passage is connected to the intake passage downstream of a throttle valve. An inlet of the first blowby gas returning passage and an inlet of the second blowby gas returning passage are placed adjacent to each other in a head cover. A check valve is provided in the first blowby gas returning passage.

8 Claims, 10 Drawing Sheets

(56) References Cited

FOREIGN PATENT DOCUMENTS

| | | |
|---|---|---|
| JP | A-2008-111422 | 5/2008 |
| JP | A-2008-184935 | 8/2008 |
| JP | A-2009-299645 | 12/2009 |
| WO | WO 2008/041113 A2 | 4/2008 |

OTHER PUBLICATIONS

Jan. 17, 2014 Chinese Office Action issued in Application No. 201210093416.3 (w/ English Translation).
Jun. 17, 2014 Office Action issued in Japanese Patent Application No. 2011-082051 (w/English Translation).

* cited by examiner

BLOWBY GAS RETURNING APPARATUS FOR ENGINE WITH SUPERCHARGER

CROSS-REFERENCE TO RELATED APPLICATIONS

This application is based upon and claims the benefit of priority from the prior Japanese Patent Application No. 2011-082051, filed on Apr. 1, 2011, the entire contents of which are incorporated herein by reference.

TECHNICAL FIELD

The present invention relates to a blowby gas returning apparatus for engine with supercharger, the apparatus being provided in an engine including a supercharger or turbocharger in an intake passage and arranged to return blowby gas generated in the engine to the engine through the intake passage.

BACKGROUND ART

This type of technique is conventionally known as disclosed for example in Patent documents 1 to 4 listed below. In particular, in an engine provided with a supercharger in an intake passage, a blowby gas returning apparatus disclosed in Patent document 1 includes a fresh-air introduction passage to introduce fresh air from the intake passage into a head cover, a first blowby gas returning passage to return the blowby gas accumulated in a crank case to the engine during operation of the supercharger, and a second blowby gas returning apparatus to return the blowby gas accumulated in the head cover to the engine during non-operation of the supercharger. An inlet of the first blowby gas returning passage and an inlet of the second blowby gas returning passage are connected individually to blowby-gas accumulation parts (the crank case, the head cover).

In the apparatus disclosed in Patent document 1, since the inlet of the first blowby gas returning passage and the inlet of the second blowby gas returning passage are connected to the different accumulation parts (the crank case, the head cover) placed apart from each other, any problem with backflow of gas between the inlets does not occur.

RELATED ART DOCUMENTS

Patent Documents

JP 2009-299645 A
JP 2004-60475 A
JP 2008-95528 A
JP 2008-184935 A

DISCLOSURE OF THE INVENTION

Problems to be Solved by the Invention

Meanwhile, in the case where the inlet of the first blowby gas returning passage and the inlet of the second blowby gas returning passage are disposed adjacent to each other in a common accumulation part (e.g., the head cover), the apparatus in Patent document 1 may cause the following problems. Specifically, during operation of the engine but non-operation of the supercharger, a negative pressure generated in the intake passage acts on the head cover through the second blowby gas returning passage, and further the negative pressure acts on the inlet of the first blowby gas returning passage.

Accordingly, the negative pressure may cause air to flow back from the first blowby gas returning passage to the head cover, and such back-flowing air may directly flow in the intake passage through the second blowby gas returning passage. Consequently, there is a possibility that the blowby gas in the head cover could not flow in the intake passage through the second blowby gas returning passage nor return to the engine.

The present invention has been made in view of the above circumstances and has a purpose to provide a blowby gas returning apparatus for engine with supercharger, the apparatus being configured such that an inlet of a first blowby gas returning passage to be used during operation of the supercharger and an inlet of a second blowby gas returning passage to be used during non-operation of the supercharger are placed adjacent to each other in a common accumulation part, so that blowby gas is effectively returned to the engine during operation of the engine and irrespective of whether during operation or non-operation of the supercharger.

Means of Solving the Problems

To achieve the above object, one aspect of the invention provides a blowby gas returning apparatus for engine with supercharger, provided in an engine including a supercharger in an intake passage and a throttle valve in the intake passage downstream of the supercharger, to allow blowby gas generated in the engine to flow to the intake passage to return to the engine, the blowby gas returning apparatus comprising: a bypass passage that connects an upstream side and a downstream side of the supercharger in the intake passage; an ejector for generating a negative pressure in the bypass passage; a first blowby gas returning passage for allowing the blowby gas to flow to the intake passage during operation of the supercharger, the first blowby gas returning passage including an outlet connected to the bypass passage through the ejector; and a second blowby gas returning passage for allowing the blowby gas to flow to the intake passage during non-operation of the supercharger, the second blowby gas returning passage including an outlet connected to the intake passage downstream of the throttle valve, wherein an inlet of the first blowby gas returning passage and an inlet of the second blowby gas returning passage are placed adjacent to each other in a common accumulation part for accumulating the blowby gas, and the blowby gas returning apparatus further includes a backflow preventing unit placed in the first blowby gas returning passage to prevent a flow of air in a direction opposite to a direction of allowing the blowby gas to flow.

Further, another aspect of the invention provides a blowby gas returning apparatus for engine with supercharger, provided in an engine including a supercharger in an intake passage and a throttle valve in the intake passage downstream of the supercharger, to allow blowby gas generated in the engine to flow to the intake passage to return to the engine, the blowby gas returning apparatus comprising: a bypass passage that connects an upstream side and a downstream side of the supercharger in the intake passage; an ejector for generating a negative pressure in the bypass passage; a first blowby gas returning passage for allowing the blowby gas to flow to the intake passage during operation of the supercharger, the first blowby gas returning passage including an outlet connected to the bypass passage through the ejector; and a second blowby gas returning passage for allowing the blowby gas to flow to the intake passage during non-operation of the supercharger, the second blowby gas returning passage including an outlet connected to the intake passage downstream of the throttle valve, wherein an inlet of the first blowby gas returning passage and an inlet of the second blowby gas returning passage are placed adjacent to each other in a common accumulation part for accumulating the blowby gas, and the blowby gas returning apparatus further includes an isolating unit for separating the inlet of the first blowby gas returning passage and the inlet of the second blowby gas returning passage from each other.

Effects of Invention

According to the invention configured such that an inlet of a first blowby gas returning passage to be used during operation of a supercharger and an inlet of a second blowby gas returning passage to be used during non-operation of the supercharger are placed adjacent to each other in a common accumulation part, so that a blowby gas is effectively returned to an engine during operation of the engine and irrespective of whether during operation or non-operation of the supercharger.

MODE FOR CARRYING OUT THE INVENTION

<First Embodiment>

A detailed description of a first preferred embodiment of a blowby gas returning apparatus for engine with supercharger embodying the present invention will now be given referring to the accompanying drawings.

Figure 1:
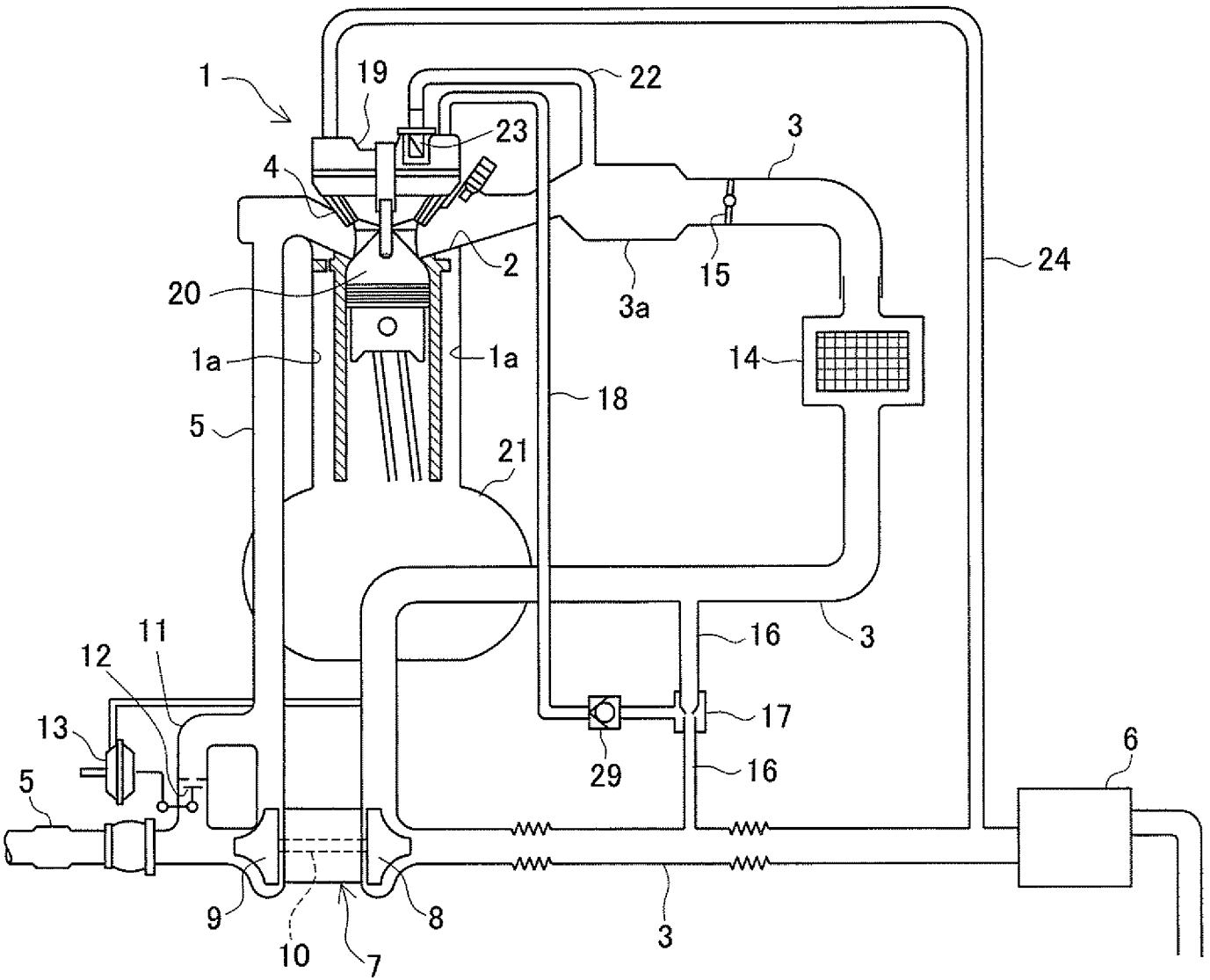
FIG. 1 is a schematic configuration view showing an engine system including a blowby gas returning apparatus for engine with supercharger in a first embodiment.

FIG. 1 is a schematic configuration view showing an engine system including a blowby gas returning apparatus for engine with supercharger in the present embodiment. This engine system includes a reciprocal engine 1. This engine 1 includes an intake port 2 connected to an intake passage 3 and an exhaust port 4 connected to an exhaust passage 5. In an inlet of the intake passage 3, an air cleaner 6 is provided. A supercharger 7 is placed in a position downstream of the air cleaner 6 in the intake passage 3 and between the intake passage 3 and the exhaust passage 5 to increase the pressure of intake air in the intake passage 3.

The supercharger 7 includes a compressor 8 placed in the intake passage 3, a turbine 9 placed in the exhaust passage 5, and a rotary shaft 10 that connects the compressor 8 and the turbine 9 so that they are rotatable together. The supercharger 7 is configured to rotate the turbine 9 with exhaust gas flowing in the exhaust passage 5 and integrally rotate the compressor 8 through the rotary shaft 10 in order to increase the pressure of intake air in the intake passage 3, that is, perform supercharging.

In the exhaust passage 5, adjacent to the supercharger 7, an exhaust bypass passage 11 is provided to detour the turbine 9. This bypass passage 11 is internally provided with a wastegate valve 12. This valve 12 is controlled by a diaphragm actuator 13 to adjust an opening degree. When the exhaust gas flowing in the exhaust bypass passage 11 is regulated by the wastegate valve 12, adjusting the flow rate of exhaust gas to be supplied to the turbine 9, thereby adjusting the rotational speeds of the turbine 9 and the compressor 8 to control the charging pressure by the supercharger 7.

In the intake passage 3, an intercooler 14 is placed between the compressor 8 of the supercharger 7 and the engine 1. This intercooler 14 is to cool the air whose pressure has been increased by the compressor 8 to an appropriate temperature. A surge tank 3*a* is provided in the intake passage 3, located between the intercooler 14 and the engine 1. A throttle valve 15 is placed on the upstream side of the surge tank 3*a*.

An upstream side and a downstream side of the supercharger 7 in the intake passage 3 are connected to each other through an intake bypass passage 16. Specifically, this bypass passage 16 is placed to connect a part of the intake passage 3 just downstream of the compressor 8, in which the charging pressure is increased, and another part of the intake passage 3 upstream of the compressor 8, so as to detour the compressor 8. In the bypass passage 16, an ejector 17 is placed to generate a negative pressure by the air flowing in this bypass passage 16.

Figure 2:
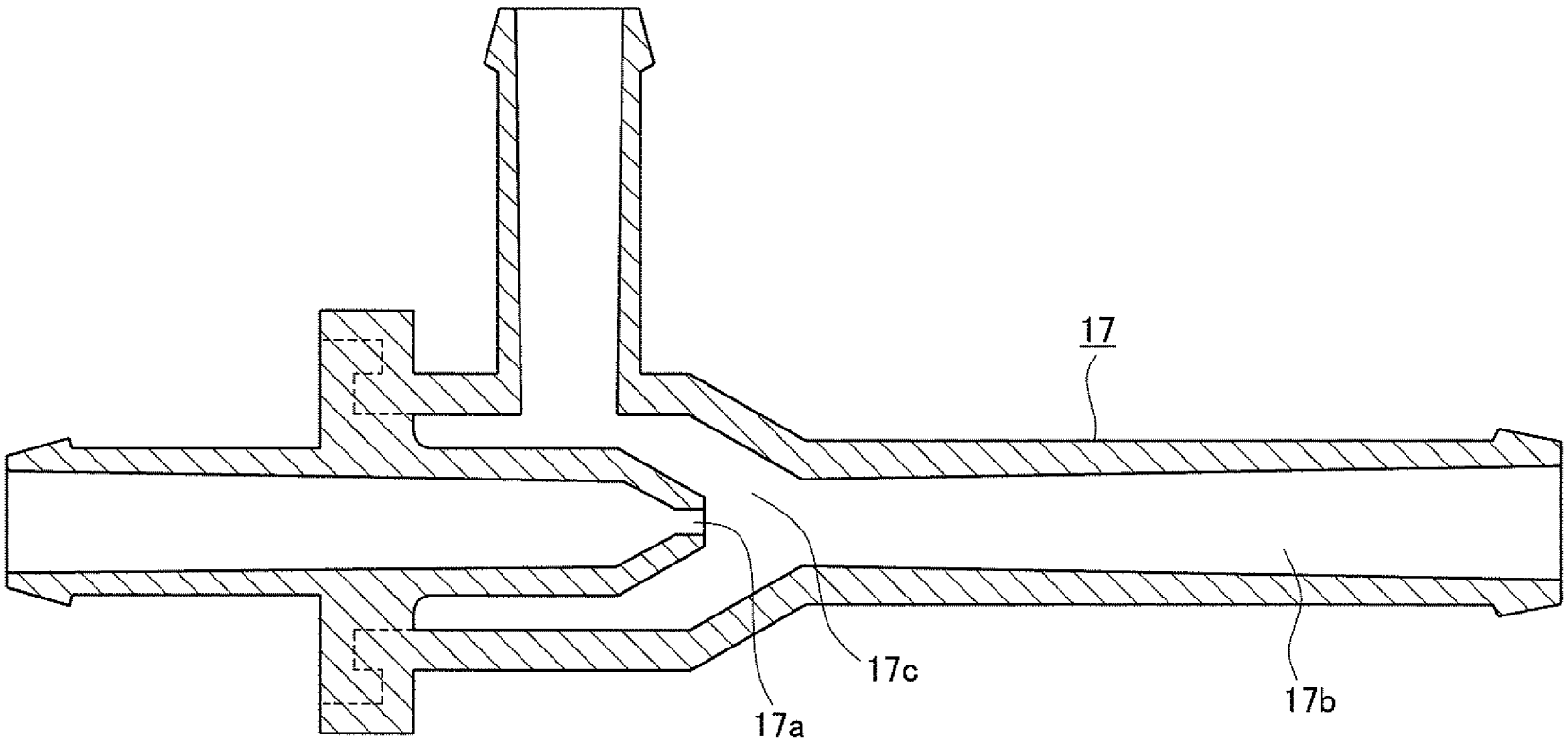
FIG. 2 is a cross-sectional view showing a schematic configuration of an ejector in the first embodiment.

FIG. 2 is a cross-sectional view showing a schematic configuration of the ejector 17. As shown in FIG. 2, the ejector 17 includes a nozzle 17*a* provided on an air inlet side, a diffuser 17*b* provided on an air outlet side, and a decompression chamber 17*c* provided between the nozzle 17*a* and the diffuser 17*b*. The ejector 17 is arranged to generate a negative pressure in the decompression chamber 17*c* by the air ejected from the nozzle 17*a*.

Specifically, when air pressure is increased by the compressor 8 during operation of the supercharger 7, a pressure difference occurs between an upstream part of the intake passage 3 from the compressor 8 and a downstream part of the intake passage 3 from the compressor 8. Thus, different intake pressures act between the nozzle 17*a* and the diffuser 17*b* in the ejector 17 through the intake bypass passage 16. Due to this pressure difference, air is ejected from the nozzle 17*a* into the diffuser 17*b*, thereby generating a negative pressure in the decompression chamber 17*c*. The magnitude of this negative pressure will be changed depending on the magnitude of charging pressure generated by the supercharger 7.

As shown in FIG. 1, the decompression chamber 17*c* of the ejector 17 (see FIG. 2) is connected to an outlet of a first blowby gas returning passage 18 to be used during operation of the supercharger 7. An inlet of the first blowby gas returning passage 18 is connected to a head cover 19 of the engine 1. The first blowby gas returning passage 18 is arranged to allow the blowby gas leaking from a combustion chamber 20 of the engine 1 into a crank case 21 to return to the combustion chamber 20 again by passing through the head cover 19 and the intake passage 3. In the present embodiment, the head cover 19 and the crank case 21 are examples of an accumulation part of the invention in which the blowby gas is accumulated.

During operation of the engine 1 and operation of the supercharger 7, a negative pressure is generated in the decompression chamber 17*c* of the ejector 17, and the generated negative pressure acts on the inside of the head cover 19 through the first blowby gas returning passage 18. By this action of the negative pressure, the blowby gas is introduced from the head cover 19 to the returning passage 18, and then this blowby gas flows to the intake passage 3 via the ejector 17 and the intake bypass passage 16. The blowby gas flowing in the intake passage 3 is returned to the combustion chamber 20 of the engine 1 via the compressor 8, the intake passage 3, and others.

In the present embodiment, an inlet of a second blowby gas returning passage 22 is connected to the head cover 19 to allow the blowby gas leaking from the combustion chamber 20 to return to the combustion chamber 20 again via the intake passage 3. An outlet of the second blowby gas returning passage 22 is connected to the surge tank 3*a* of the intake passage 3. Further, the head cover 19 is provided with a PCV valve 23 at the inlet of the second blowby gas returning passage 22.

Accordingly, during operation of the engine 1 but non-operation of the supercharger 7, the internal pressure of the surge tank 3*a* is negative, and this negative pressure acts on the inside of the head cover 19 through the second blowby gas returning passage 22. By this action of the negative pressure, the blowby gas is introduced from the head cover 19 to the returning passage 22. The blowby gas then flows in the intake passage 3 (the surge tank 3*a*) to return to the combustion chamber 20 of the engine 1. The PCV valve 23 is arranged to adjust a flow rate of blowby gas to be introduced from the head cover 19 to the second blowby gas returning passage 22.

In the present embodiment, a fresh-air introduction passage 24 is provided between the engine 1 and the intake passage 3 to introduce fresh air into the head cover 19 and the crank case 21. An inlet of this fresh-air introduction passage 24 is connected to the intake passage 3 near the air cleaner 6 while an outlet of the introduction passage 24 is connected to the head cover 19. The inside of the head cover 19 and the inside of the crank case 21 are communicated with each other through a communication passage 1*a* provided in the engine 1.

Figure 3:
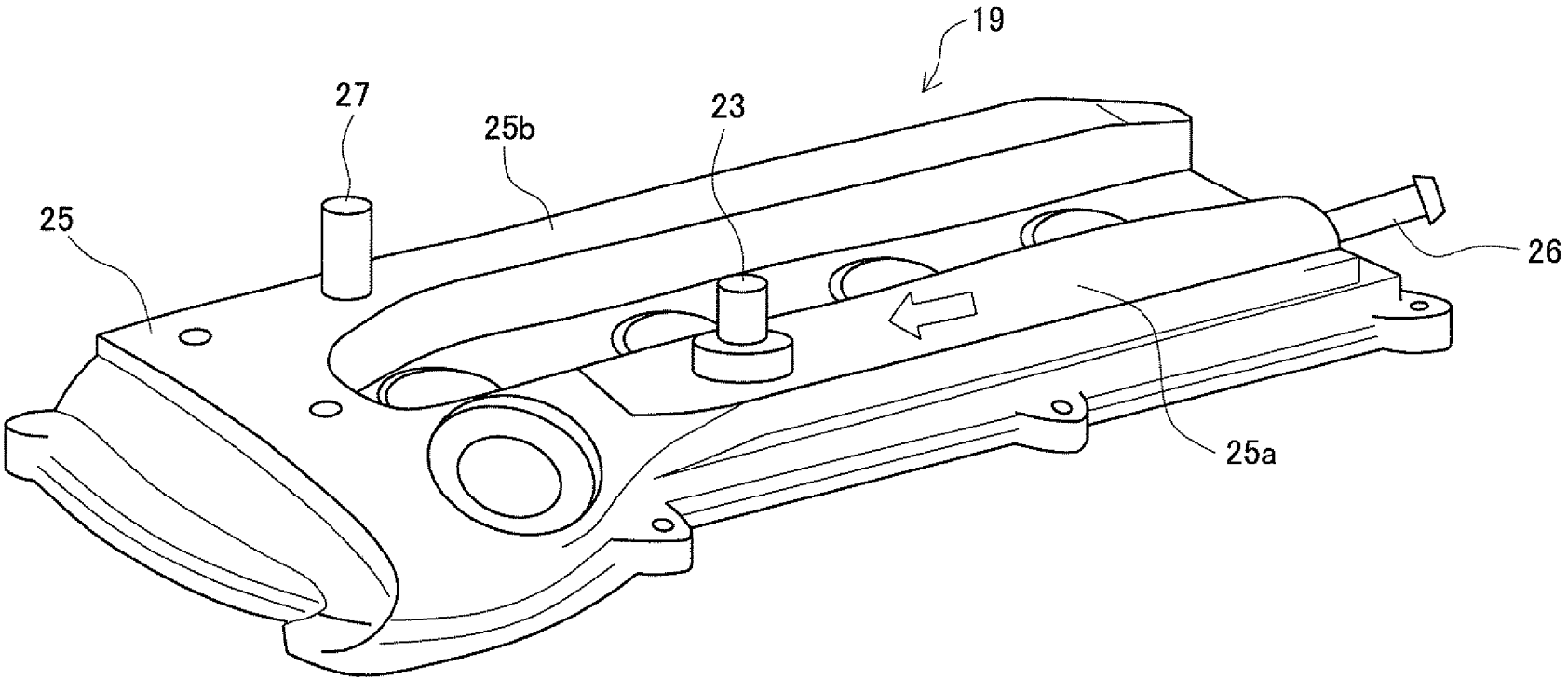
FIG. 3 is a perspective view of a head cover in the first embodiment.

FIG. 3 is a perspective view of the head cover 19. This head cover 19 includes a raised part 25 having an approximately U-like shape in plan view and providing an interior space for accumulating blowby gas. In one ridge portion 25*a* of the raised part 25, a PCV valve 23 is attached. This PCV valve 23 is connected to the inlet of the second blowby gas returning passage 22. The same ridge portion 25*a* is provided with a pipe joint 26 for blowby gas. This pipe joint 26 is connected to the inlet of the first blowby gas returning passage 18. On the other hand, the other ridge portion 25*b* of the raised part 25 is provided with a pipe joint 27 for fresh air. This pipe joint 27 is connected to an outlet of the fresh-air introduction passage 24.

Figure 4:
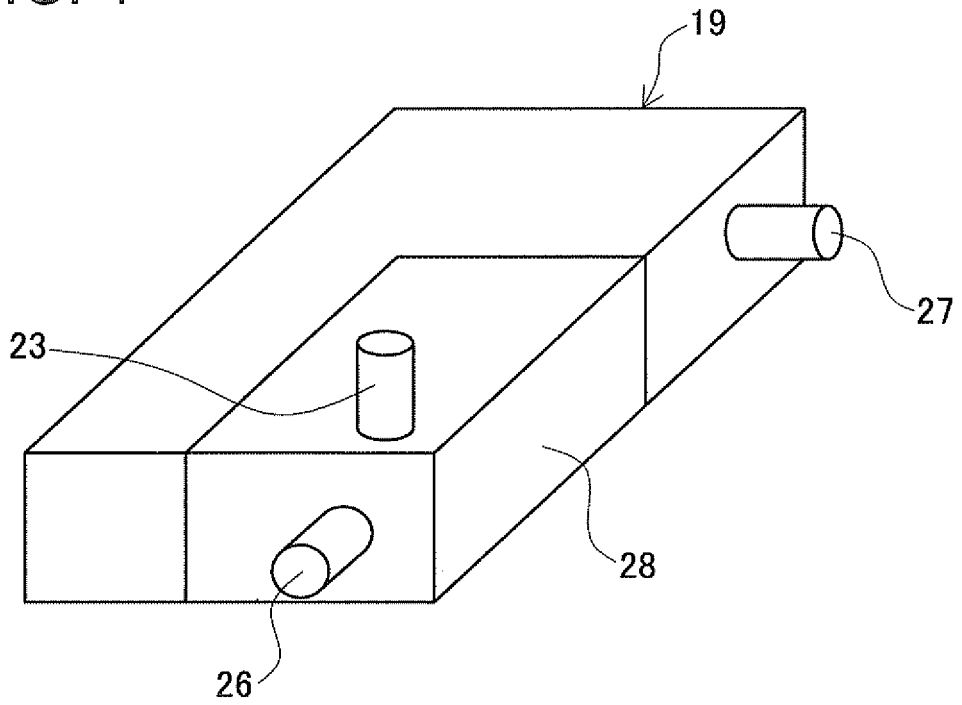
FIG. 4 is a schematic perspective diagram of the head cover in the first embodiment.

FIG. 4 is a schematic perspective diagram showing the head cover 19. As shown in FIG. 4, the head cover 19 is internally formed with a separator section 28 partitioned from the other section to separate gases and liquids. In this separator section 28, the PCV valve 23 and the pipe joint 26 for blowby gas are placed. In the other section of the head cover 19 than the separator section 28, the pipe joint 27 for fresh air is placed.

Figure 5:
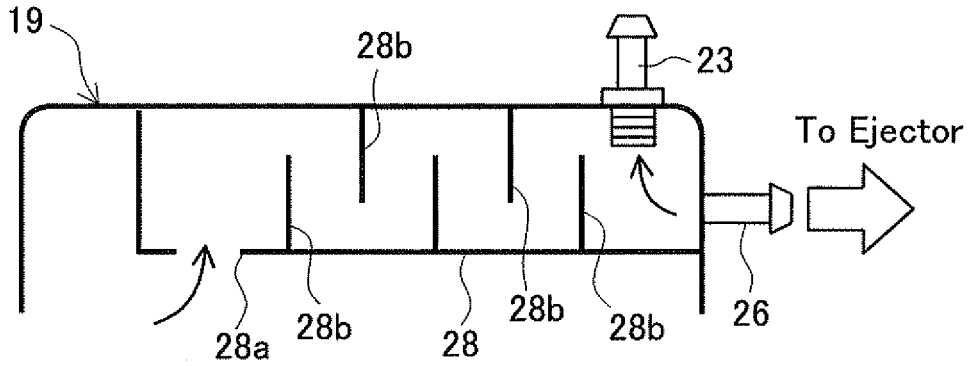
FIG. 5 is a schematic diagram showing a separator section in the head cover in the first embodiment.

FIG. 5 is a schematic diagram showing the separator section 28 in the head cover 19. As shown in FIG. 5. the separator section 28 includes an inlet 28*a* and is internally formed with a plurality of fins 28*b* alternately different in orientation and arranged in a labyrinth-like pattern. The pipe joint 26 for blowby gas and the PCV valve 23 are placed adjacent to each other in the same compartment in the separator section 28.

However, the following matter is conceivable from the above configuration that the pipe joint 26 and the PCV valve 23 are placed adjacently in the same compartment. Specifically, during operation of the engine 1 but non-operation of the supercharger 7, a negative pressure generated in the surge tank 3*a* acts on the inside of the head cover 19 through the second blowby gas returning passage 22 and the PCV valve 23. At that time, the negative pressure also acts on the pipe joint 26. Thus, atmospheric air flowing from the ejector 17 side flows in the head cover 19 through the first blowby gas returning passage 18 and the pipe joint 26. Such air flowing in the head cover 19 passes through the PCV valve 23 under negative pressure into the second blowby gas returning passage 22 and thus no blowby gas enters in the separator section 28 through the inlet 28*a*. This may result in a possibility that the interior space of the head cover 19 and the interior space of the crank case 21 cannot be ventilated.

In the present embodiment, therefore, as shown in FIG. 1, a check valve 29 serving as a backflow preventing unit is placed in the first blowby gas returning passage 18, near the ejector 17, to stop a flow of gas in an opposite direction to a direction of allowing the blowby gas to flow. This check valve 29 permits the flow of blowby gas that attempts to flow from the head cover 19 toward the ejector 17 but blocks the flow of air in the opposite direction thereto.

According to the blowby gas returning apparatus for engine with supercharger in the present embodiment, during operation of the engine 1 and non-operation of the supercharger 7, a negative pressure generated in the intake passage 3 (the surge tank 3*a*) downstream of the throttle valve 15 acts on the second blowby gas returning passage 22. By this action of negative pressure, the blowby gas accumulated in the head cover 19 is caused to flow to the intake passage 3 through the PCV valve 23 and the second blowby gas returning passage 22. As a result, during non-operation of the supercharger 7, the blowby gas in the head cover 19 can be returned to the combustion chamber 20 through the intake passage 3. At that time, an amount of the blowby gas allowed to flow from the head cover 19 to the second blowby gas returning passage 22 is regulated to an appropriate amount by the PCV valve 23.

In the present embodiment, the inlet of the first blowby gas returning passage 18 and the inlet of the second blowby gas returning passage 22 are placed adjacent to each other in the common head cover 19. In other words, the pipe joint 26 connected to the inlet of the first blowby gas returning passage 18 and the PCV valve 23 connected to the inlet of the second blowby gas returning passage 22 are placed adjacently in the common space in the separator section 28 of the head cover 19. Accordingly, the negative pressure applied from the intake passage 3 (the surge tank 3*a*) acts on the inside of the head cover 19 through the second blowby gas returning passage 22 and others and also on the first blowby gas returning passage 18. In the present embodiment, however, in the first blowby gas returning passage 18, the flow of air in the direction opposite to the direction of permitting the flow of blowby gas is blocked by the check valve 29. Thus, no air flows from the ejector 17 side to the head cover 19 through the first blowby gas returning passage 18 and others. Therefore, the atmospheric air does not directly flow to the inlet of the second blowby gas returning passage 22 via the inlet of the first blowby gas returning passage 18. This ensures the flow of blowby gas toward the second blowby gas returning passage 22.

When the blowby gas flows from the head cover 19 to the intake passage 3 through the second blowby gas returning passage 22 and others, fresh air (atmospheric air) is introduced into the head cover 19 through the fresh-air introduction passage 24 and the pipe joint 27. This makes it possible to ventilate the inside of the head cover 19 with the fresh air. Further, since the inside of the head cover 19 is ventilated, the blowby gas accumulated in the crank case 21 is introduced into the head cover 19 through the communication passage 1*a*. Thus, the inside of the crank case 21 can also be ventilated.

In the present embodiment, the PCV valve 23 is placed in the inlet of the second blowby gas returning passage 22, so that the flow rate of blowby gas allowed to flow to the second blowby gas returning passage 22 is regulated to an appropriate amount by the PCV valve 23. This can prevent returning of an excessive amount of blowby gas to the combustion chamber 20 through the second blowby gas returning passage 22.

On the other hand, during operation of the engine 1 and operation of the supercharger 7, the internal pressure of the intake passage 3 downstream of the supercharger 7 is high. The negative pressure does not act on the outlet of the second blowby gas returning passage 22. Accordingly, the blowby gas does not flow from the head cover 19 to the intake passage 3 through the PCV valve 23 and the second blowby gas returning passage 22.

At that time, a pressure difference in intake air occurs between the upstream side and the downstream side of the supercharger 7 in the intake passage 3, and similarly a pressure difference occurs between both ends of the intake bypass passage 16. Due to this pressure differences, air is caused to flow in the intake bypass passage 16, thereby generating a negative pressure in the ejector 17. Accordingly, this negative pressure acts on the outlet of the first blowby gas returning passage 18, causing the blowby gas accumulated in the head cover 19 to flow to the intake passage 3 through the first blowby gas returning passage 18, the ejector 17, and the intake bypass passage 16. In this way, during operation of the supercharger 7, the blowby gas in the head cover 19 can be returned to the combustion chamber 20 through the intake passage 3.

When charging pressure provided by the supercharger 7 increases, the pressure difference between both ends of the intake bypass passage 16 increases, and accordingly a larger negative pressure is generated in the ejector 17. Therefore, the flow rate of blowby gas allowed to flow from the head cover 19 to the intake passage 3 through the first blowby gas returning passage 18 and others is increased, so that a large amount of blowby gas is returned to the combustion chamber 20.

Since the intake bypass passage 16 is provided by detouring a part of the intake passage 3, the bypass passage 16 and the ejector 17 will not affect intake resistance in the intake passage 3. During operation of the supercharger 7, accordingly, it is possible to return the blowby gas to the combustion chamber 20 without increasing intake resistance in the intake passage 3.

Further, when the blowby gas flows from the head cover 19 to the intake passage 3 through the first blowby gas returning passage 18 and others, fresh air (atmospheric air) is introduced from outside into the head cover 19 through the fresh-air introduction passage 24 and the pipe joint 27. Accordingly, the inside of the head cover 19 can be ventilated with this fresh air. Further, when the inside of the head cover 19 is ventilated, the blowby gas accumulated in the crank case 21 is introduced into the head cover 19 through the communication passage 1*a*. Thus, the inside of the crank case 21 can also be ventilated.

In the present embodiment, as explained above, in which the inlet of the first blowby gas returning passage 18 to be used during operation of the supercharger 7 and the inlet of the second blowby gas returning passage 22 to be used during non-operation of the supercharger 7 are placed adjacent to each other in the common head cover 19, the blowby gas in the head cover 19 and the blowby gas in the crank case 21 can be effectively returned to the combustion chamber 20 of the engine 1 during operation of the engine 1 and irrespective of whether during operation or non-operation of the supercharger 7.

In the present embodiment, when the blowby gas accumulated in the head cover 19 flows from the inlet of the first blowby gas returning passage 18 or the inlet of the second blowby gas returning passage 22 toward the intake passage 3, fresh air is introduced from outside into the head cover 19 through the fresh-air introduction passage 24. Therefore, the fresh air introduced in the head cover 19 allows ventilation of the inside of the head cover 19 and simultaneously the inside of the crank case 21.

In the present embodiment, the outlet of the fresh-air introduction passage 24, the inlet of the first blowby gas returning passage 18, and the inlet of the second blowby gas returning passage 22 are connected to the single head cover 19, so that those three passages 24, 18, and 22 are easily arranged. Accordingly, an easier piping work is achieved.

<Second Embodiment>

A second embodiment of the blowby gas returning apparatus for engine with supercharger according to the present invention will be explained in detail referring to accompanying drawings.

In each of the embodiments described below, similar or identical components or parts to those in the first embodiment are given the same reference signs and their details are not repeated below. Differences from the first embodiment are focused on.

Figure 6:
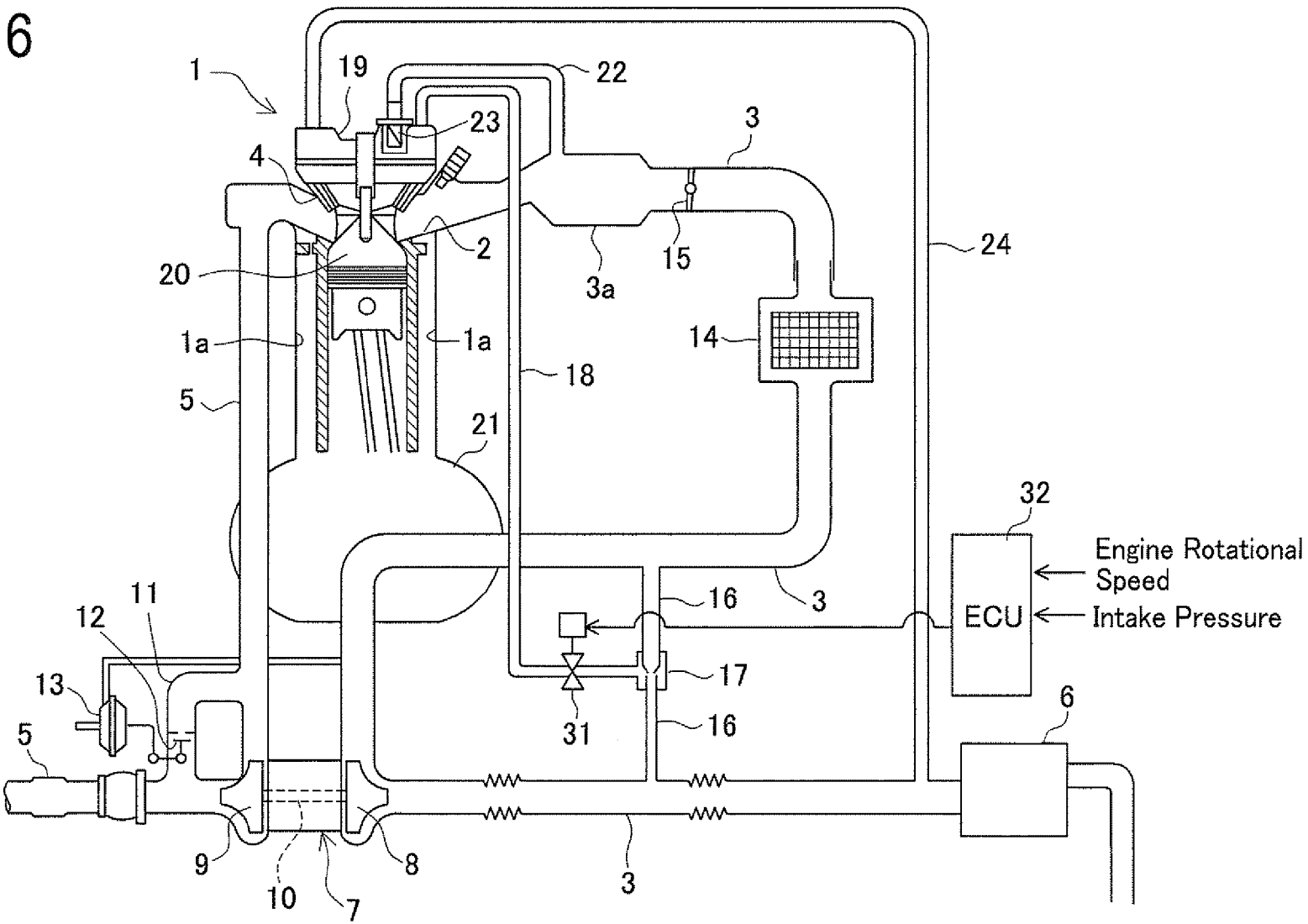
FIG. 6 is a schematic configuration view showing an engine system including a blowby gas returning apparatus for engine with supercharger in a second embodiment.

FIG. 6 is a schematic configuration view of an engine system including the blowby gas returning apparatus for engine with supercharger of the present embodiment. In this embodiment, instead of the check valve 29 in the first embodiment, a vacuum switching valve (VSV) 31 is placed near the ejector 17 in the first blowby gas returning passage 18. This VSV 31 is configured to be controlled by an electronic control unit (ECU) 32 according to an operating status of the engine 1. The present embodiment differs in such a configuration from the first embodiment.

Herein, the ECU 32 is configured to receive detection values such as engine rotational speed and intake pressure from various sensors (not shown) provided in the engine 1 and control the VSV 31 based on those detection values. In the present embodiment, the VSV 31 and the ECU 32 constitute one example of a backflow preventing unit of the present invention.

Figure 7:
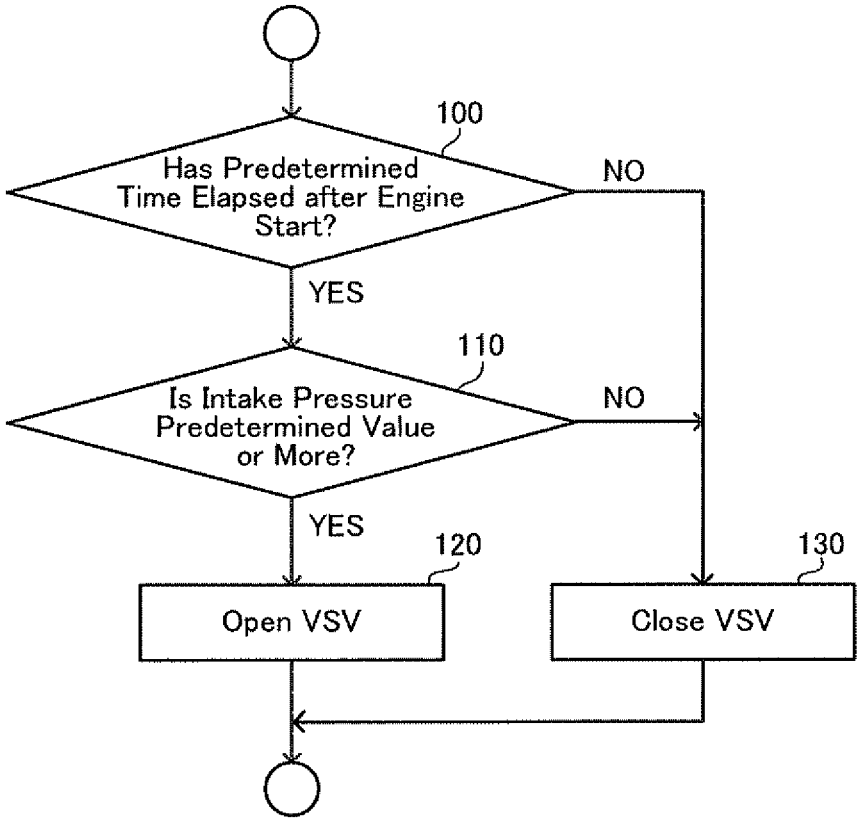
FIG. 7 is a flowchart showing details of a control program to be executed by an ECU in the second embodiment.

FIG. 7 is a flowchart showing the details of a control program to be executed by the ECU 32. When the processing advances to this routine, the ECU 32 determines first at step 100 whether or not a predetermined time has elapsed from engine start. If this determination result is negative, the engine 1 is identified as being in a state before completion of warm-up, and the ECU 32 closes the VSV 31 at step 130. With this VSV 31, the first blowby gas returning passage 18 is thus closed, intercepting a flow of air in the passage 18.

On the other hand, if the determination result at step 100 is affirmative, the ECU 32 then determines at step 110 whether the intake pressure is a predetermined value or more. If this determination result is negative, the supercharger 7 is considered to be non-operational after completion of warm-up of the engine 1, and the ECU 32 closes the VSV 31 as in the above case.

If an affirmative result is obtained at step 110, on the other hand, the supercharger 7 is considered to be operational after completion of warm-up of the engine 1, the ECU 32 opens the VSV 31 at step 120. Thus, with the VSV 31, the first blowby gas returning passage 18 is opened, thereby allowing air to flow in the intake bypass passage 16 according to the charging pressure. This generates a negative pressure in the ejector 17 according to the magnitude of the charging pressure. Accordingly, the negative pressure generated in the ejector 17 acts on the inside of the head cover 19 through the first blowby gas returning passage 18, thus causing blowby gas to flow out of the head cover 19 into the first blowby gas returning passage 18 according to the magnitude of charging pressure. Consequently, the blowby gas is returned to the combustion chamber 20 through the ejector 17, intake bypass passage 16, intake passage 3, and others.

According to the blowby gas returning apparatus for engine with supercharger in the present embodiment explained above, the VSV 31 is controlled according to the operating status of the engine 1, the first blowby gas returning passage 18 can be opened by the VSV 31 during operation of the supercharger 7. Accordingly, during operation of the supercharger 7, the ejector 17 is actuated to cause the blowby gas in the head cover 19 to flow to the intake passage 3 through the first blowby gas returning passage 18 and others and thus return to the combustion chamber 20.

On the other hand, the VSV 31 is controlled according to the operating status of the engine 1, the first blowby gas returning passage 18 is closed by the VSV 31 during non-operation of the supercharger 7. This can prevent the air in the ejector 17 side to flow back to the head cover 19 through the first blowby gas returning passage 18. When the negative pressure applied from the intake passage 3 (surge tank 3*a*) acts on the inside of the head cover 19 through the second blowby gas returning passage 22 and the PCV valve 23, the blowby gas in the separator section 28 is caused to flow toward the PCV valve 23 through the inlet 28*a*. During non-operation of the supercharger 7, therefore, the blowby gas in the head cover 19 is allowed to flow to the intake passage 3 (surge tank 3*a*) and thus return to the combustion chamber 20.

In the present embodiment, as above, the first blowby gas returning passage 18 can be opened and closed by the VSV 31 according to the operating status of the engine 1, that is, whether during operation or non-operation of the supercharger 7. Accordingly, in the configuration that the inlet of the first blowby gas returning passage 18 to be used during operation of the supercharger 7 and the inlet of the second blowby gas returning passage 22 to be used during non-operation of the supercharger 7 are placed adjacent to each other in the common head cover 19, the blowby gas can be efficiently returned to the combustion chamber 20 of the engine 1 during operation of the engine 1 and irrespective of whether operation or non-operation of the supercharger. Other operations and effects are substantially the same as those in the first embodiment.

<Third Embodiment>

A third embodiment of the blowby gas returning apparatus for engine with supercharger according to the present invention will be explained in detail below referring to the accompanying drawings.

Figure 8:
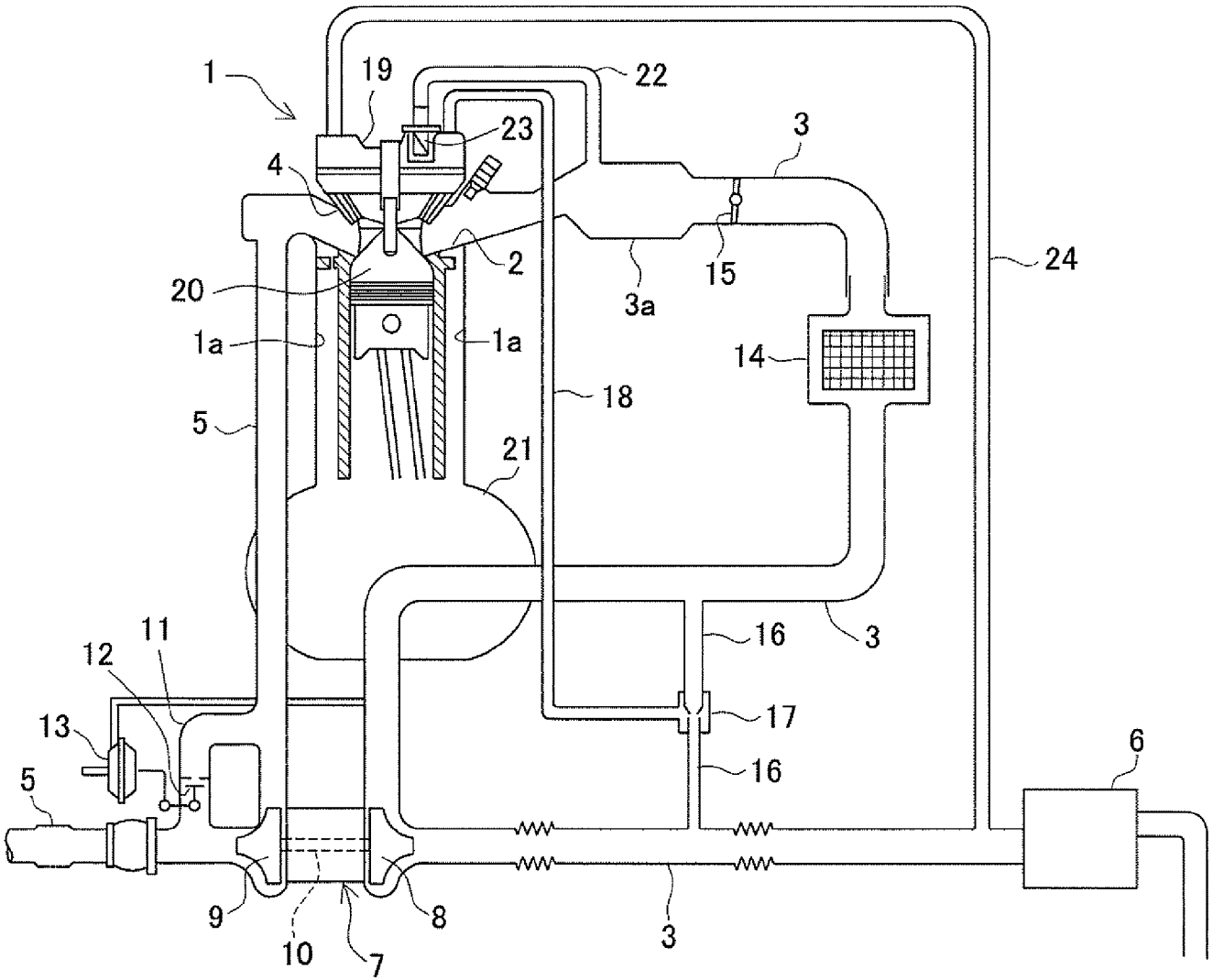
FIG. 8 is a schematic configuration view showing an engine system including a blowby gas returning apparatus for engine with supercharger in a third embodiment.

FIG. 8 is a schematic configuration view showing an engine system including the blowby gas returning apparatus for engine with supercharger of the present embodiment. This embodiment does not include the check valve 29 provided in the first blowby gas returning passage 18 in the first embodiment. Instead, the present embodiment differs from the first embodiment in the configuration of separator sections 28A and 28B (see FIG. 9) of the head cover 19.

Figure 9:
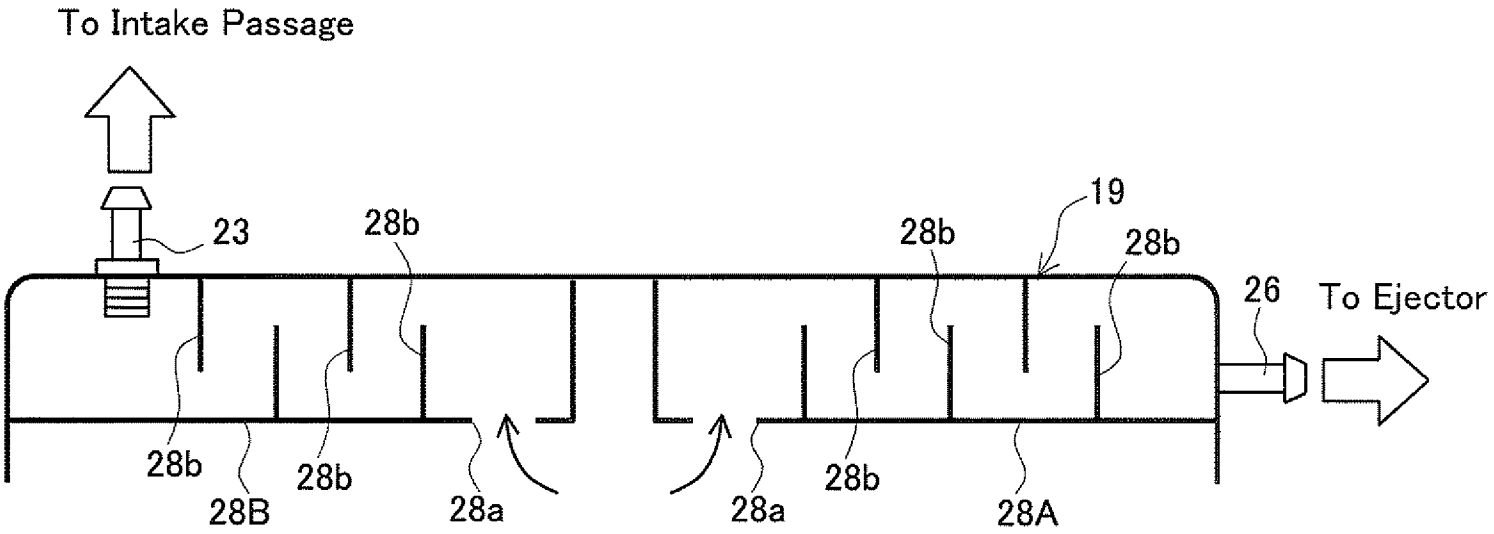
FIG. 9 is a schematic diagram showing two separator sections in a head cover in the third embodiment.

FIG. 9 is a schematic diagram showing two separator sections 28A and 28B in the head cover 19. As shown in FIG. 9, the head cover 19 is internally provided with two separator sections 28A and 28B separated or isolated from each other. Each of the separator sections 28A and 28B includes an inlet 28*a* and a plurality of fins 28*b* arranged in a labyrinth-like pattern. The first separator section 28A is provided with the pipe joint 26. This pipe joint 26 is connected to an inlet of the first blowby gas returning passage 18. The second separator section 28B is provided with the PCV valve 23. This PCV valve 23 is connected to an inlet of the second blowby gas returning passage 22. Specifically, the separator sections 28A and 28B are provided respectively at the inlet of the first blowby gas returning passage 18 and the inlet of the second blowby gas returning passage 22 to separate liquids from the blowby gas. Those two separator sections 28A and 28B correspond to one example of an isolating unit of the present invention to separate or isolate the inlet of the first blowby gas returning passage 18 and the inlet of the second blowby gas returning passage 22 from each other.

According to the blowby gas returning apparatus for engine with supercharger in the present embodiment described above, the head cover 19 is provided with the two separator sections 28A and 28B separated from each other. Further, the first separator section 28A is provided with the pipe joint 26 connected to the inlet of the first blowby gas returning passage 18. The second separator section 28B is provided with the PCV valve 23 connected to the inlet of the second blowby gas returning passage 22.

Accordingly, during operation of the engine 1 and operation of the supercharger 7, a negative pressure acts on the first blowby gas returning passage 18 by the action of the ejector 17, thereby causing the blowby gas in the head cover 19 to flow to the intake passage 3 through the first separator section 28A, first blowby gas returning passage 18, ejector 17, and intake bypass passage 16. Thus, the blowby gas flowing in the intake passage 3 can be returned to the combustion chamber 20 of the engine 1.

On the other hand, during operation of the engine 1 but non-operation of the supercharger 7, the negative pressure generated in the intake passage 3 (surge tank 3*a*) causes the blowby gas in the head cover 19 to flow to the intake passage 3 (surge tank 3*a*) through the second separator section 28B, PCV valve 23, and second blowby gas returning passage 22. Thus, the blowby gas flowing in the intake passage 3 can be returned to the combustion chamber 20 of the engine 1.

Herein, although the inlet of the first blowby gas returning passage 18 and the inlet of the second blowby gas returning passage 22 are placed adjacent to each other in the common head cover 19, the inlets of the blowby gas returning passages 18 and 22 are isolated from each other by the separator sections 28A and 28B. Accordingly, this configuration prevents direct introduction of air from the ejector 17 side to the inlet of the second blowby gas returning passage 22 through the first blowby gas returning passage 18 and others.

Specifically, during non-operation of the supercharger 7, the negative pressure acting on the second blowby gas returning passage 22 acts on the second separator section 28B through the PCV valve 23, but does not directly act on the first separator section 28A. Therefore, the air is not drawn from the ejector 17 side to the first separator section 28A through the first blowby gas returning passage 18. Also, this air is not allowed to flow to the second blowby gas returning passage 22 through the second separator section 28B and the PCV valve 23. This ensures the flow of blowby gas from the second separator section 28B toward the PCV valve 23 and the second blowby gas returning passage 22.

Consequently, in the configuration that the inlet of the first blowby gas returning passage 18 to be used during operation of the supercharger 7 and the inlet of the second blowby gas returning passage 22 to be used during non-operation of the supercharger 7 are placed adjacent to each other in the common head cover 19, the blowby gas can be efficiently returned to the combustion chamber 20 of the engine 1 during operation of the engine 1 and irrespective of during operation or non-operation of the supercharger 7. Other operations and effects are substantially the same as those in the first embodiment.

<Fourth Embodiment>

A fourth embodiment of the blowby gas returning apparatus for engine with supercharger according to the present invention will be explained in detail below referring to the accompanying drawings.

Figure 10:
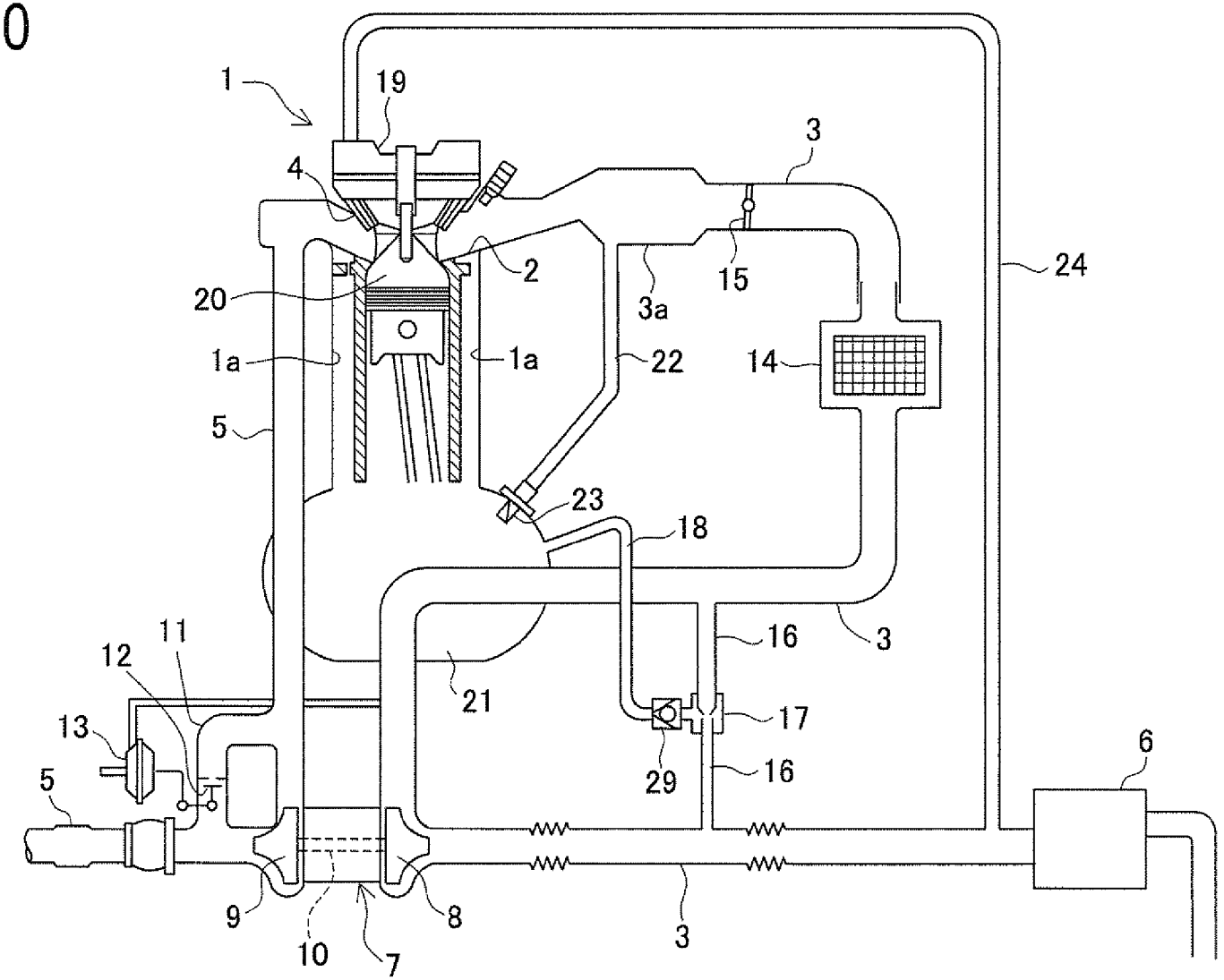
FIG. 10 is a schematic configuration view showing an engine system including a blowby gas returning apparatus for engine with supercharger in a fourth embodiment.

FIG. 10 is a schematic configuration view showing an engine system including the blowby gas returning apparatus for engine with supercharger of the present embodiment. In this embodiment, the inlet of the first blowby gas returning passage 18 is connected to the crank case 21, not to the head cover 19, and the inlet of the second blowby gas returning passage 22 is connected to the crank case 21, not to the head cover 19, through the PCV valve 23. Further, a pipe joint (not shown) connected to the inlet of the first blowby gas returning passage 18 and the PCV valve 23 connected to the inlet of the second blowby gas returning passage 22 are placed adjacent to each other in the crank case 21 serving as a common accumulation part of the invention. The above configuration of the present embodiment differs from the first embodiment.

According to the blowby gas returning apparatus for engine with supercharger in the present embodiment described as above, a negative pressure generated by the action of the ejector 17 acts on the first blowby gas returning passage 18 during operation of the engine 1 and operation of the supercharger 7, thereby causing the blowby gas accumulated in the crank case 21 to flow to the intake passage 3 through the first blowby gas returning passage 18, ejector 17, and intake bypass passage 16. Consequently, the blowby gas flowing in the intake passage 3 can be returned to the combustion chamber 20 of the engine 1.

On the other hand, during operation of the engine 1 but non-operation of the supercharger 7, a negative pressure generated in the intake passage 3 (surge tank 3*a*) causes the blowby gas in the crank case 21 to flow to the intake passage 3 (surge tank 3*a*) through the PCV valve 23 and second blowby gas returning passage 22. Consequently, the blowby gas flowing in the intake passage 3 can be returned to the combustion chamber 20 of the engine 1.

Herein, the inlet of the first blowby gas returning passage 18 and the inlet of the second blowby gas returning passage 22 are placed adjacently in the common crank case 21 that stores the blowby gas. Thus, the negative pressure acting on the crank case 21 through the second blowby gas returning passage 22 also attempts to act on the first blowby gas returning passage 18. In the present embodiment, however, the check valve 29 blocks the flow of air in an opposite direction to a direction of allowing the flow of blowby gas in the first blowby gas returning passage 18, so that no air is allowed to flow from the ejector 17 side to the crank case 21 through the first blowby gas returning passage 18. Accordingly, no atmospheric air directly flows to the second blowby gas returning passage 22 via the first blowby gas returning passage 18. This ensures the flow of blowby gas toward the second blowby gas returning passage 22.

In the present embodiment, consequently, in the configuration that the inlet of the first blowby gas returning passage 18 to be used during operation of the supercharger 7 and the inlet of the second blowby gas returning passage 22 to be used during non-operation of the supercharger 7 are placed adjacently in the common crank case 21, the blowby gas can be efficiently returned to the combustion chamber 20 during operation of the engine 1 and irrespective of whether operation or non-operation of the supercharger 7.

In the present embodiment, furthermore, when the blowby gas accumulated in the crank case 21 flows toward the intake passage 3 through the inlet of the first blowby gas returning passage 18 or the inlet of the second blowby gas returning passage 22, fresh air is introduced into the head cover 19 from outside through the fresh-air introduction passage 24. Fresh air introduced in the head cover is also introduced into the crank case 21 through the communication passage 1*a*. Therefore, the inside of the head cover 19 can be ventilated with the fresh air introduced in the head cover 19 and further the inside of the crank case 21 can be ventilated with the fresh air introduced in the crank case 21.

Since the inlet of the first blowby gas returning passage 18 and the inlet of the second blowby gas returning passage 22 are connected to the same crank case 21, the aforementioned two blowby gas returning passages 19 and 22 can be easily arranged. Accordingly, an easier piping work is achieved. Other operations and effects are substantially the same as those in the first embodiment.

<Fifth Embodiment>

A fifth embodiment of the blowby gas returning apparatus for engine with supercharger according to the present invention will be explained in detail below referring to the accompanying drawings.

Figure 11:
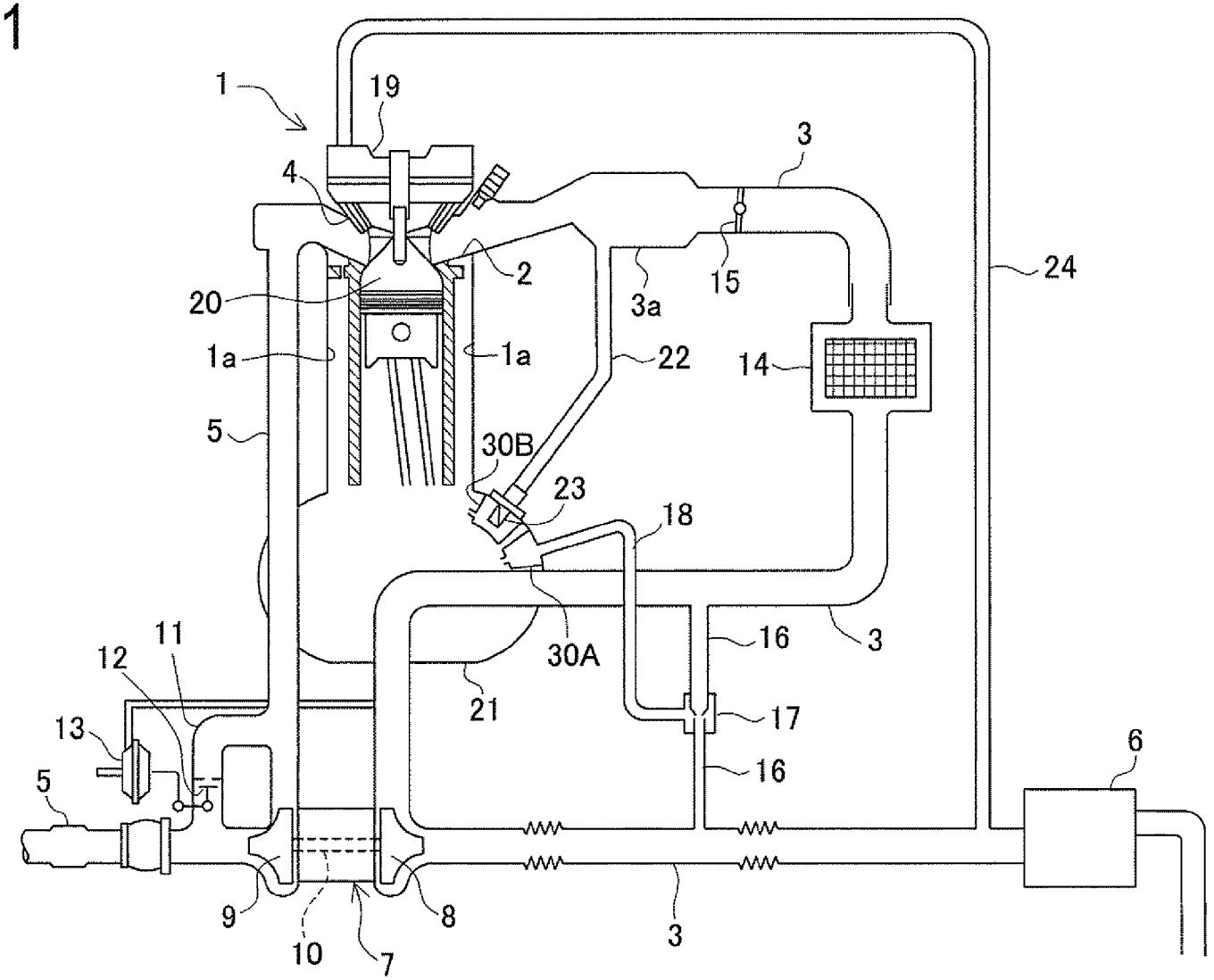
FIG. 11 is a schematic diagram showing an engine system including a blowby gas returning apparatus for engine with supercharger in a fifth embodiment.

FIG. 11 is a schematic configuration view showing an engine system including the blowby gas returning apparatus for engine with supercharger of the present embodiment. This embodiment does not include the check valve 29 provided in the first blowby gas returning passage 18 in the fourth embodiment. Instead, the present embodiment is different from the fourth embodiment in that the crank case 21 is provided with two separator sections 30A and 30B.

Specifically, as shown in FIG. 11, the crank case 21 is internally provided with two separate separator sections 30A and 30B isolated from each other. Each of the separator sections 30A and 30B has the same configurations as the aforementioned two separator sections 28A and 28B. The first separator section 30A is connected to the inlet of the first blowby gas returning passage 18. The second separator section 30B is connected to the inlet of the second blowby gas returning passage 22 through the PCV valve 23. Specifically, the inlet of the first blowby gas returning passage 18 and the inlet of the second blowby gas returning passage 22 are provided respectively with the separator sections 30A and 30B. Those two separator sections 30A and 30B correspond to one example of the isolating unit of the present invention to separate or isolate the inlet of the first blowby gas returning passage 18 and the inlet of the second blowby gas returning passage 22 from each other.

According to the blowby gas returning apparatus for engine with supercharger in the present embodiment described as above, a negative pressure generated by the action of the ejector 17 acts on the first blowby gas returning passage 18 during operation of the engine 1 and operation of the supercharger 7, thereby causing the blowby gas accumulated in the crank case 21 to flow to the intake passage 3 through the first separator section 30A, first blowby gas returning passage 18, ejector 17, and intake bypass passage 16. Consequently, the blowby gas flowing in the intake passage 3 can be returned to the combustion chamber 20 of the engine 1.

On the other hand, during operation of the engine 1 but non-operation of the supercharger 7, a negative pressure generated in the intake passage 3 (surge tank 3*a*) causes the blowby gas in the crank case 21 to flow to the intake passage 3 (surge tank 3*a*) through the second separator section 30B, PCV valve 23, and second blowby gas returning passage 22. Consequently, the blowby gas flowing in the intake passage 3 can be returned to the combustion chamber 20 of the engine 1.

Herein, the inlet of the first blowby gas returning passage 18 and the inlet of the second blowby gas returning passage 22 are placed adjacently in the common crank case 21, while the inlets of the blowby gas returning passages 18 and 22 are separated or isolated from each other by the corresponding separator sections 30A and 30B. Accordingly, no air is introduced from the ejector 17 side to the inlet of the second blowby gas returning passage 22 through the first blowby gas returning passage 18. Thus, the air is not drawn from the ejector 17 to the first separator section 30A through the first blowby gas returning passage 18. Also, this air is not allowed to flow in the second blowby gas returning passage 22 through the second separator section 30B and the PCV valve 23. Accordingly, no atmospheric air directly flows to the second blowby gas returning passage 22 via the first blowby gas returning passage 18. This ensures the flow of blowby gas toward the second blowby gas returning passage 22.

In the present embodiment, consequently, in the configuration that the inlet of the first blowby gas returning passage 18 to be used during operation of the supercharger 7 and the inlet of the second blowby gas returning passage 22 to be used during non-operation of the supercharger 7 are placed adjacently in the common crank case 21, the blowby gas can be efficiently returned to the combustion chamber 20 of the engine 1 during operation of the engine 1 and irrespective of during operation or non-operation of the supercharger 7. Other operations and effects are substantially the same as those in the fourth embodiment.

The present invention is not limited to the above embodiments and may be embodied in other specific forms without departing from the essential characteristics thereof, as mentioned below.

In the fourth embodiment, the check valve 29 is placed in the first blowby gas returning passage 18. Instead of this check valve 29, the VSV 31 to be controlled by the ECU 32 may be placed in the first blowby gas returning passage 18 as in the second embodiment.

In the third and fifth embodiments, the first separator sections 28A and 30A and the second separator sections 28B and 30B are provided as the isolating unit of the present invention. The isolating unit is not limited to the above separator sections and has only to have a function of isolating the inlet of the first blowby gas returning passage and the inlet of the second blowby gas returning passage from each other. For instance, the inlet of each blowby gas returning passage may be configured as a simple compartment having a vent hole.

INDUSTRIAL APPLICABILITY

The present invention can be utilized in for example an engine with supercharger for vehicle.

DESCRIPTION OF THE REFERENCE SIGNS

1 Engine
3 Intake passage
3*a* Surge tank
7 Supercharger
15 Throttle valve
16 Intake bypass passage
17 Ejector
18 First blowby gas returning passage
19 Head cover
21 Crank case
22 Second blowby gas returning passage
24 Fresh-air introduction passage
28A First separator section
28B Second separator section
29 Check valve
30A First separator section
30B Second separator section
31 VSV
32 ECU

The invention claimed is:

1. A blowby gas returning apparatus for engine with supercharger, provided in an engine including a supercharger in an intake passage and a throttle valve in the intake passage downstream of the supercharger, to allow blowby gas generated in the engine to flow to the intake passage to return to the engine, the blowby gas returning apparatus comprising:

a bypass passage that connects an upstream side and a downstream side of the supercharger in the intake passage;

an ejector for generating a negative pressure in the bypass passage;

a first blowby gas returning passage for allowing the blowby gas to flow to the intake passage during operation of the supercharger, the first blowby gas returning passage including an outlet connected to the bypass passage through the ejector; and a second blowby gas returning passage for allowing the blowby gas to flow to the intake passage during non-operation of the supercharger, the second blowby gas returning passage including an outlet connected to the intake passage downstream of the throttle valve, the engine including a head cover and a crank case for accumulating the blowby gas, wherein an inlet of the first blowby gas returning passage and an inlet of the second blowby gas returning passage are both connected to the head cover at distinct locations on the head cover and are located adjacent to each other, and the blowby gas returning apparatus further includes a backflow preventing unit placed in the first blowby gas returning passage to prevent a flow of air in a direction opposite to a direction of allowing the blowby gas to flow.

2. The blowby gas returning apparatus for engine with supercharger according to claim 1, wherein the backflow preventing unit is a check valve provided in the first blowby gas returning passage to block a flow of gas in a direction opposite to a direction of allowing the blowby gas to flow.

3. The blowby gas returning apparatus for engine with supercharger according to claim 1, wherein the backflow preventing unit includes a vacuum switching valve placed in the first blowby gas returning passage and an electronic control unit for controlling the vacuum switching valve according to an operating status of the engine.

4. A blowby gas returning apparatus for engine with supercharger, provided in an engine including a supercharger in an intake passage and a throttle valve in the intake passage downstream of the supercharger, to allow blowby gas generated in the engine to flow to the intake passage to return to the engine, the blowby gas returning apparatus comprising:

a bypass passage that connects an upstream side and a downstream side of the supercharger in the intake passage;

an ejector for generating a negative pressure in the bypass passage;

a first blowby gas returning passage for allowing the blowby gas to flow to the intake passage during operation of the supercharger, the first blowby gas returning passage including an outlet connected to the bypass passage through the ejector; and a second blowby gas returning passage for allowing the blowby gas to flow to the intake passage during non-operation of the supercharger, the second blowby gas returning passage including an outlet connected to the intake passage downstream of the throttle valve, the engine including a head cover and a crank case for accumulating the blowby gas, wherein an inlet of the first blowby gas returning passage and an inlet of the second blowby gas returning passage are either both connected to the head cover or both connected to the crank case, and wherein the inlet of the first blowby gas returning passage and the inlet of the second blowby gas returning passage are both connected to one of the head cover and the crank case at distinct locations on the one of the head cover and the crank case and are located adjacent to each other, the blowby gas returning apparatus further includes an isolating unit for separating the inlet of the first blowby gas returning passage and the inlet of the second blowby gas returning passage from each other, and the isolating unit includes a first compartment and a second compartment separated from each other in the one of the head cover and the crank case, each of the first compartment and the second compartment including a vent hole, the inlet of the first blowby gas returning passage being connected to the first compartment and the inlet of the second blowby gas returning passage being connected to the second compartment.

5. The blowby gas returning apparatus for engine with supercharger according to claim 4, wherein the blowby gas returning apparatus further includes a fresh-air introduction passage for introducing fresh air from outside into the head cover, an outlet of the fresh-air introduction passage, the inlet of the first blowby gas returning passage, and the inlet of the second blowby gas returning passage are connected to the head cover.

6. The blowby gas returning apparatus for engine with supercharger according to claim 4, wherein the inside of the head cover and the inside of the crank case are communicated with each other through a communication passage provided in the engine, and the blowby gas returning apparatus further includes a fresh-air introduction passage for introducing fresh air from outside into the head cover, an outlet of the fresh-air introduction passage is connected to the head cover, and the inlet of the first blowby gas returning passage and the inlet of the second blowby gas returning passage are connected to the crank case.

7. The blowby gas returning apparatus for engine with supercharger according to claim 4, wherein the first compartment and the second compartment include two separator sections provided in the head cover, the separator sections being partitioned from another part of the head cover to separate gases and liquids and separated from each other.

8. The blowby gas returning apparatus for engine with supercharger according to claim 4, wherein the first compartment and the second compartment include two separator sections provided in the crank case, the separator sections being partitioned from another part of the crank case to separate gases and liquids and separated from each other.

* * * * *